US009748721B2

(12) United States Patent
Endo et al.

(10) Patent No.: US 9,748,721 B2
(45) Date of Patent: Aug. 29, 2017

(54) METHOD OF FABRICATING CONNECTOR TERMINALS

(71) Applicant: DAI-ICHI SEIKO CO., LTD., Kyoto (JP)

(72) Inventors: Takayoshi Endo, Shizuoka (JP); Masaya Muta, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 222 days.

(21) Appl. No.: 14/564,905

(22) Filed: Dec. 9, 2014

(65) Prior Publication Data

US 2015/0188273 A1 Jul. 2, 2015

(30) Foreign Application Priority Data

Dec. 26, 2013 (JP) ..... 2013-269383

(51) Int. Cl.

| | |
|---|---|
| ***H01R 43/16*** | (2006.01) |
| ***H01B 1/02*** | (2006.01) |
| *H01R 24/60* | (2011.01) |
| *H01R 107/00* | (2006.01) |

(52) U.S. Cl.

CPC ..... *H01R 43/16* (2013.01); *H01B 1/02* (2013.01); *H01R 24/60* (2013.01); *H01R 2107/00* (2013.01); *Y10T 29/49204* (2015.01); *Y10T 428/1241* (2015.01)

(58) Field of Classification Search

CPC ..... H01R 9/24; H01R 43/00; H01R 43/16; H01R 24/60; H01R 2107/00; H05K 1/07; H01B 1/02; Y10T 29/49204; Y10T 428/1241

See application file for complete search history.

(56) References Cited

U.S. PATENT DOCUMENTS

| | | | | |
|---|---|---|---|---|
| 4,783,906 | A * | 11/1988 | Gingerich | H02K 5/148 29/827 |
| 5,062,818 | A * | 11/1991 | Wasimoto | H01K 1/46 264/272.16 |
| 5,409,386 | A | 4/1995 | Banakis et al. | 439/83 |
| 6,141,872 | A * | 11/2000 | Takanashi | H01R 43/16 29/827 |
| 6,659,814 | B2 | 12/2003 | Kojima | 439/884 |

(Continued)

FOREIGN PATENT DOCUMENTS

| | | | |
|---|---|---|---|
| JP | 3-116572 | 12/1991 | H01R 13/04 |
| JP | 2724681 | 12/1997 | H01R 9/09 |

(Continued)

*Primary Examiner* — Carl Arbes

(74) *Attorney, Agent, or Firm* — Hayes Soloway P.C.

(57) ABSTRACT

A method of fabricating connector terminals, includes (a) preparing a single electrically conductive metal sheet including a plurality of pre-terminals, and a plurality of carriers connecting adjacent pre-terminals to each other, each of the pre-terminals having at one end thereof in a length-wise direction thereof an elastically deformable contact portion, and at the other end in the length-wise direction a first area, a pitch between adjacent contact portions being unequal to a pitch between adjacent first areas, (b) folding each of the first areas around a line extending in a length-wise direction thereof to thereby form a male tab having a predetermined thickness, and (c) removing the carriers out of the metal sheet.

2 Claims, 14 Drawing Sheets

(56) References Cited

U.S. PATENT DOCUMENTS

| | | | | |
|---|---|---|---|---|
| 7,226,323 | B2 * | 6/2007 | Noro | H01R 43/16 29/874 |
| 8,341,839 | B2 * | 1/2013 | Ishida | H01R 43/16 29/874 |
| 2009/0158585 | A1 | 6/2009 | Yajima | 29/874 |

FOREIGN PATENT DOCUMENTS

| | | | |
|---|---|---|---|
| JP | 2003-168537 | 6/2003 | H01R 43/16 |
| JP | 3823811 | 7/2006 | H01R 13/04 |
| JP | 2009-158169 | 7/2009 | H01R 43/24 |
| JP | 3156761 | 12/2009 | H01R 4/02 |
| KR | 200314796 | 5/2003 | H01R 9/00 |

* cited by examiner

METHOD OF FABRICATING CONNECTOR TERMINALS

BACKGROUND OF THE INVENTION

Field of the Invention

The invention relates to a method of fabricating connector terminals to be used for electrical connection between devices equipped in an automobile, for instance. The invention relates further to an electrically conductive metal sheet to which the method is applied Description of the Related Art In a process of fabricating a relay connector terminal including a plurality of terminals each having at one of ends thereof a contact portion, and at the other end a male tab, the terminals are put in a line within a pair of dies, and then, are fabricated by die-casting, in order to effectively carry out the process.

A relay terminal to be compressed into an object is made of a thin metal sheet, and is designed to have a male tab made of a folded metal sheet to cause the male tab to have an increased thickness. Thus, the male tab can have a designed thickness and a sufficient rigidity.

FIG. 14 is a broken perspective view of the electric connector suggested in Japanese Utility Model Publication No. 3156761.

The electric connector 500 illustrated in FIG. 14 includes an electrically insulative body 501, a plurality of terminals 502 fixed to the body 501, a fixing unit 503 to which the body 51 is fixed, and a housing 504 covering the body 501 therewith.

The body 501 is formed with a plurality of holes 510 through which the terminals 502 are inserted. Each of the terminals 502 includes a contact portion 520, a central portion 521 at which the terminal 502 is fixed in the hole 510, and a rear portion 522. The rear portion 522 includes an inclining portion 523, and a connection portion 524 at which the terminal 502 is soldered to an object. Since each of the terminals 502 is designed to include the inclining portion 523, a pitch between the adjacent connection portions 524 is greater than a pitch between the adjacent contact portions 520.

FIG. 15 is a plan view of the electric connector suggested in Japanese Utility Model Application Publication No. H03 (1991)-116572.

The electric connector includes a female connector, and a male connector detachably coupled to the female connector.

FIG. 16 is a perspective view of a part of the male connector 600, and FIG. 17 is a cross-sectional view of the male connector 600.

As illustrated in FIGS. 15 to 17, the male connector 600 is formed at a proximal end 600*a* thereof with a plurality of standing walls 600*b* and 600*c* in which a stripped portion 620*a* of a cable 620 is compressed to thereby be fixed. The male connector 600 includes a guide 600*d* having a rectangular cross-section. The male connector 600 is formed at a front end thereof with a contact portion 601. As illustrated in FIG. 17, the contact portion 601 is made of a flat metal sheet folded into two layers, in which ends 601*a* of the two layers align with each other.

In a terminal as a part of a relay connector terminal, it is necessary to design a contact portion to be made of a thin metal sheet in order to provide requisite elasticity to the contact portion. In contrast, it is necessary to design a male tab to be made of a thick metal sheet in order to allow the male tab to have both a predetermined thickness and a requisite rigidity.

To this end, a conventional terminal was designed to be made of metal sheets having different shapes from one another, or to include a contact portion pressed to have a reduced thickness. However, these conventional processes are accompanied with problems that the fabrication costs are unavoidably increased in the former, and the elasticity of the contact portion is lowered in the latter because of hardening of a metal sheet caused by being pressed. The latter is accompanied further with a problem that since a metal sheet from which the contact portion is fabricated has to be wider if the metal sheet had a smaller thickness, it is necessary to carry out an additional step of controlling a width of the metal sheet into a designed width.

Furthermore, in the case that a relay terminal to be compressed into an object is designed to include a male tab fabricated by folding a metal sheet to thereby have a predetermined increased thickness, a step of bending a metal sheet has to be carried out in a plurality of times in the process of fabricating the male tab, and hence, it is difficult to enhance an efficiency of the process.

The problems mentioned above are not able to be solved by the above-mentioned conventional electric connectors illustrated in FIGS. 14 to 17.

SUMMARY OF THE INVENTION

In view of the above-mentioned problems in the conventional electric connectors, it is an object of the present invention to provide a method of fabricating connector terminals, capable of avoiding complexity in a fabrication process, and providing required performances to a contact portion and a male tab.

It is further an object of the present invention to provide an electrically conductive metal sheet from which connector terminals are fabricated. In other words, the above-mentioned method can be applied to the metal sheet to fabricate connector terminals.

In one aspect of the present invention, there is provided a method of fabricating connector terminals, including (a) preparing a single electrically conductive metal sheet including a plurality of pre-terminals, and a plurality of carriers connecting adjacent pre-terminals to each other, each of the pre-terminals having at one end thereof in a length-wise direction thereof an elastically deformable contact portion, and at the other end in the length-wise direction a first area, a pitch between adjacent contact portions being unequal to a pitch between adjacent first areas, (b) folding each of the first areas around a line extending in a length-wise direction thereof to thereby form a male tab having a predetermined thickness, and (c) removing the carriers out of the metal sheet to turn the pre-terminals into terminals.

In accordance with the above-mentioned method, each of the resultant terminals are able to include a contact portion having sufficient elasticity, and a male tab having a predetermined thickness and a requisite rigidity. Accordingly, the contact portion and the male tab can accomplish required performances. In addition, it is not necessary to carry out a step of reducing a thickness of the contact portion, ensuring that the elasticity caused by hardening of a metal sheet in a step of reducing a thickness of the metal sheet can be avoided from being lowered, and further, the complexity in a process of fabricating the contact portion can be avoided.

It is preferable that the first areas situated adjacent to each other are folded in the step (b) in opposite directions, in which case, for instance, the first areas are simultaneously folded.

A step of folding the first areas can be carried out simultaneously in the adjacent first areas. This ensures simplification in a process of fabricating the connector terminals.

It is preferable that the first areas situated adjacent to each other are folded in the step (b) in a common direction, in which case, for instance, first areas are simultaneously folded.

It is preferable that each of the first areas is folded in the step (b) such that there is formed a gap between facing portions of the metal sheet.

It is preferable that the step (a) is carried out by pressing an electrically conductive metal sheet.

In another aspect of the present invention, there is provided an electrically conductive metal sheet including a plurality of pre-terminals situated in parallel, and a plurality of carriers connecting adjacent pre-terminals to each other, each of the pre-terminals having at one end thereof in a length-wise direction thereof an elastically deformable contact portion, and at the other end in the length-wise direction a first area, a pitch between adjacent contact portions being unequal to a pitch between adjacent first areas, a pitch between the N-th first area and the (N+1)-th first area and a pitch between the (N+2)-th first area and the (N+3)-th first area being equal to each other, wherein N indicates an integer 1, 5, 9, 13 . . . .

In still another aspect of the present invention, there is provided an electrically conductive metal sheet including a plurality of pre-terminals situated in parallel, and a plurality of carriers connecting adjacent pre-terminals to each other, each of the pre-terminals having at one end thereof in a length-wise direction thereof an elastically deformable contact portion, and at the other end in the length-wise direction a first area, a pitch between adjacent contact portions being unequal to a pitch between adjacent first areas, a pitch between the first areas situated adjacent to each other being constant.

For instance the first area is designed to be rectangular.

The advantages obtained by the aforementioned present invention will be described hereinbelow.

The present invention provides a connector terminal capable of being fabricated without complexity in a fabrication process, and including a contact portion and a male tab both providing required performances.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

First Embodiment

Figure 1:
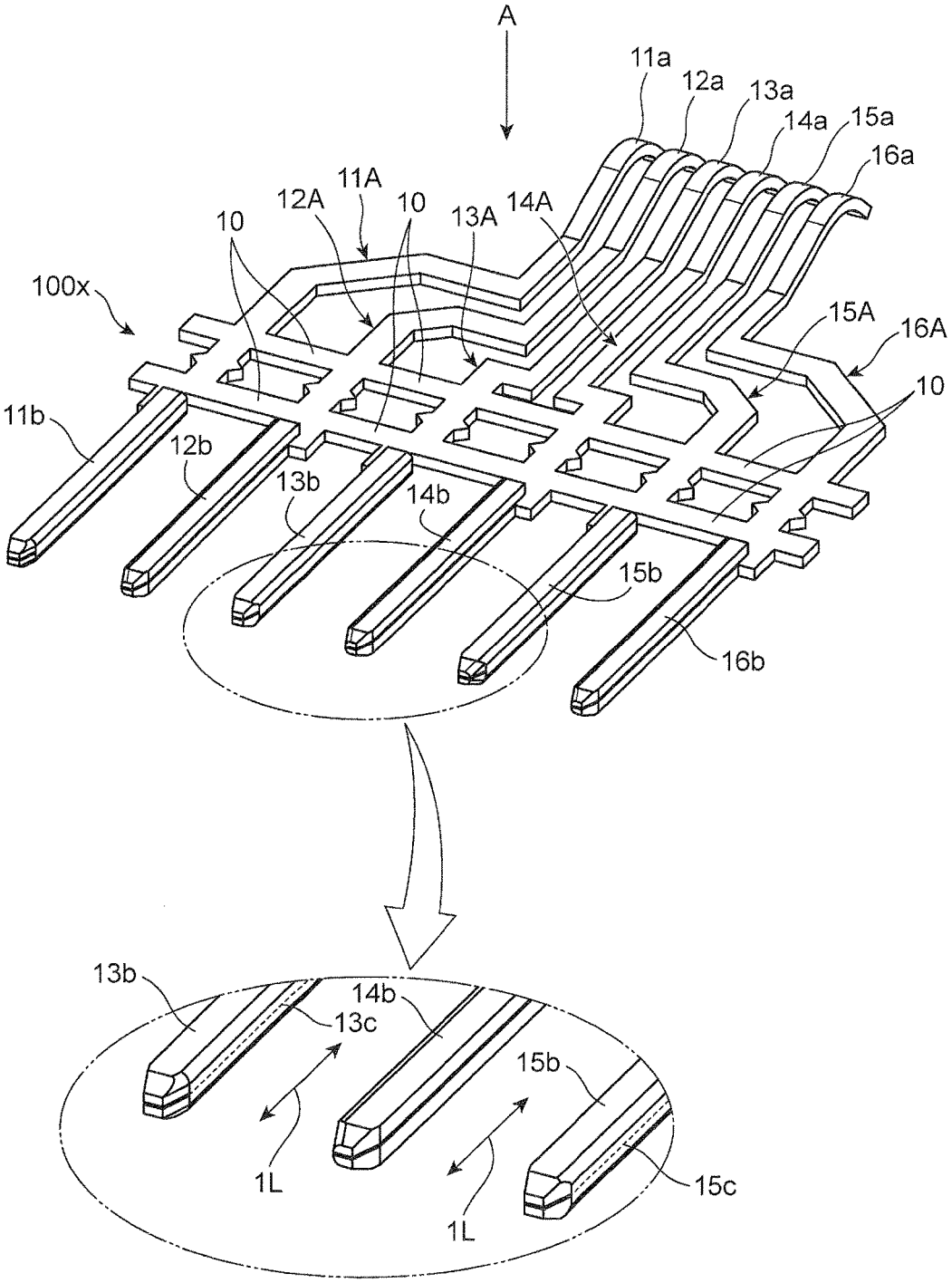
FIG. 1 is a perspective view of a metal sheet to which the method in accordance with the preferred embodiment of the present invention is applied.
Figure 2:
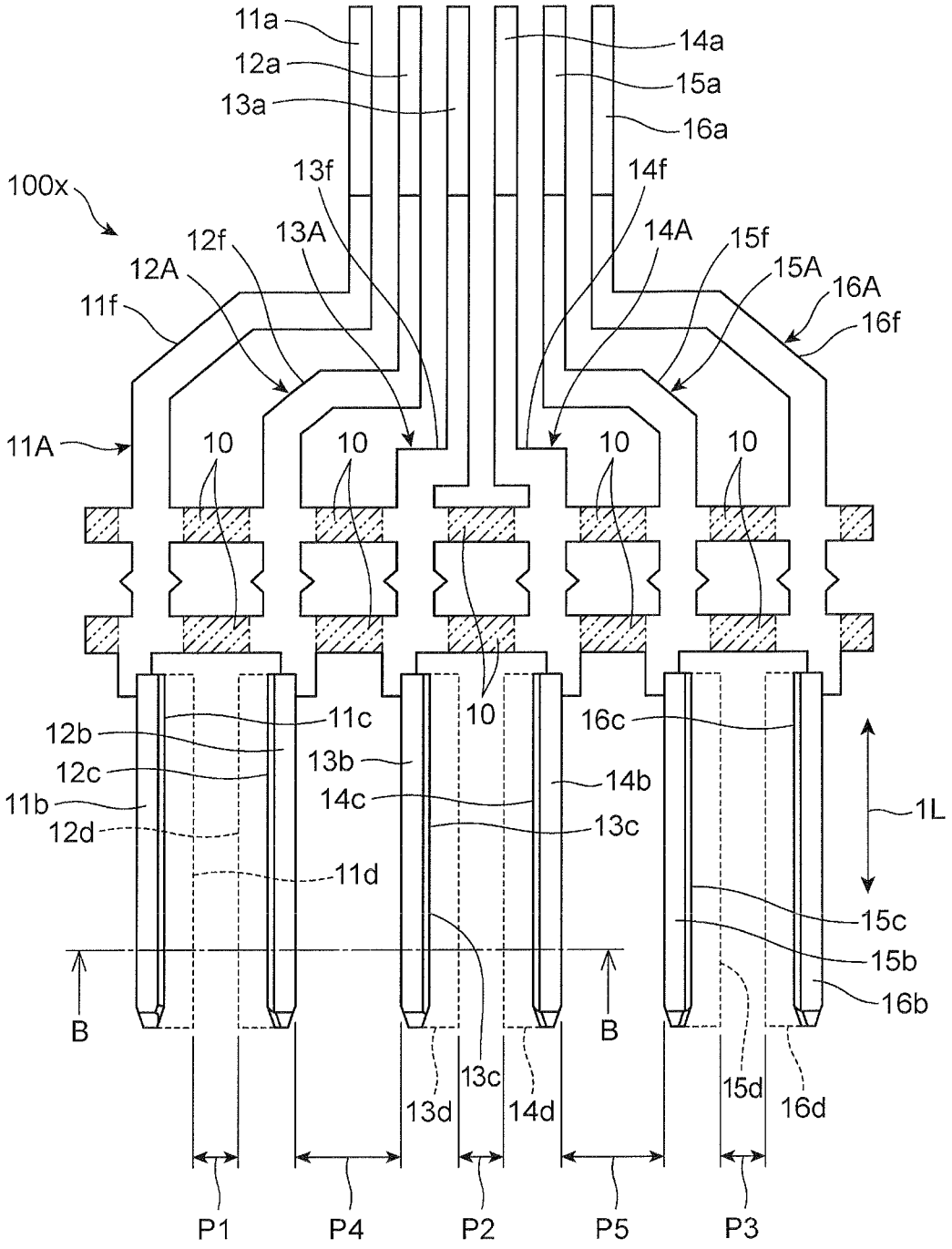
FIG. 2 is a plan view of the metal sheet viewed in the direction indicated with an arrow A shown in FIG. 1.

FIGS. 1 and 2 illustrate an electrically conductive metal sheet 100*x* including a plurality of pre-terminals 11A to 16A situated in parallel, and a plurality of carriers 10 (illustrated as hatched portions in FIG. 2) connecting adjacent pre-terminals to each other.

The metal sheet 100*x* is fabricated by pressing a plan metal sheet. Each of the pre-terminals 11A to 16A is designed to include at one end thereof in a length-wise direction thereof an elastically deformable contact portion 11*a* to 16*a*, at the other end in the length-wise direction a rectangular first area 11*d* to 16*d* (illustrated with a broken line in FIG. 2), and a connecting portion 11*f* to 16*f* connecting the contact portion 11*a* to 16*a* with the first area 11*d* to 16*d*. The connecting portions 11*f* to 16*f* are designed to incline and/or extend perpendicularly relative to the length-wise direction of the pre-terminals 11A to 16A, as illustrated in FIG. 2.

Because of the connecting portions 11*f* to 16*f* connecting the contact portions 11*a* to 16*a* with the first areas 11*d* to 16*d*, a pitch between the adjacent contact portions 11*a* to 16*a* and a pitch between the adjacent first areas 11*d* to 16*d* are not equal to each other.

Figure 3:
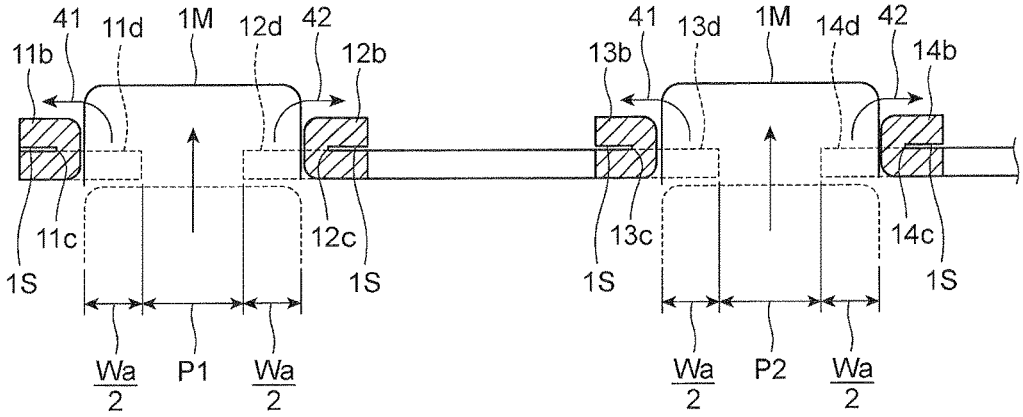
FIG. 3 is a cross-sectional view taken along the line B-B shown in FIG. 2.

The first areas 11*d* to 16*d* are designed to have a common width Wa (see FIG. 3).

As mentioned later, the pre-terminals 11A to 16A are turned into terminals 11 to 16 (see FIG. 6) by removing the carriers 10 out of the metal sheet 100*x* and folding the first areas 11*d* to 16*d* to thereby form male tabs 11*b* to 16*b* (see FIG. 1).

In the metal sheet 100*x*, a pitch between the adjacent contact portions 11*a* to 16*a* is designed to be smaller than a pitch between the adjacent first areas 11*d* to 16*d*. It should be noted that a relation between the pitches is not to be limited to the above-mentioned one. For instance, in the case that a circuit is large in size, a pitch between the adjacent contact portions 11*a* to 16*a* may be greater than a pitch between the adjacent first areas 11*d* to 16*d*. As an alternative, in the case that the male tabs 11*b* to 16*b* are designed to be small in size, a pitch between the adjacent contact portions 11*a* to 16*a* may be greater than a pitch between the adjacent first areas 11*d* to 16*d*.

The male tabs 11*b* to 16*b* of the terminals 11 to 16 are formed by folding the first areas 11*d* to 16*d* into a two-layered structure around lines 11*c* to 16*c* extending in parallel with a length-wise direction 1L of the first areas 11*d* to 16*d*.

As illustrated in FIGS. 2 and 3, the first areas 11*d* and 12*d* of the pre-terminals 11 and 12 situated adjacent to each other are folded in opposite directions. Specifically, as illustrated in FIG. 3, a right half of the first area 11*d* in the pre-terminal 11A is folded onto a left half of the first area 11*d*, as indicated with an arrow 41. Thus, the resultant terminal 11 illustrated in FIG. 6 has a two-layered or folded structure. Similarly, a left half of the first area 12*d* in the pre-terminal 12A is folded onto a right half of the first area 12*d*, as indicated with an arrow 42. Thus, the resultant terminal 12 illustrated in FIG. 6 has a two-layered or folded structure.

The first areas 13*d* and 14*d* of the pre-terminals 13 and 14 situated adjacent to each other are formed in the same way as the first areas 11*d* and 12*d*, and the first areas 15*d* and 16*d* of the pre-terminals 15 and 16 situated adjacent to each other are formed in the same way as the first areas 11*d* and 12*d*.

A pair of the first areas 11*d* and 12*d*, a pair of the first areas 13*d* and 14*d*, and a pair of the first areas 15*d* and 16*d* may be folded simultaneously or one by one.

As illustrated in FIG. 3, each of the first areas 11*d* to 16*d* is folded such that there is formed a gap 1S between facing portions of the metal sheet. Specifically, there is formed the gap 1S between the right and left halves of the first area 11*d* to 16*d* in the resultant terminals 11 to 16.

As mentioned above, a pitch between the adjacent contact portions 11*a* to 16*a* is smaller than a pitch between the adjacent first areas 11*d* to 16*d*. In addition, a pitch P1 between the first areas 11*d* and 12*d*, a pitch P2 between the first areas 13*d* and 14*d*, and a pitch P3 between the first areas 15*d* and 16*d* are all equal to one another. It can be generalized that a pitch between the N-th first area and the (N+1)-th first area and a pitch between the (N+2)-th first area and the (N+3)-th first area is equal to each other, wherein N indicates an integer 1+4M (M is 0 or a positive integer 1, 2, 3, 4, . . . ), that is, N is 1, 5, 9, 13 . . . .

It should be noted that a pitch P4 between the first areas 12*d* and 13*d* and a pitch P5 between the first areas 14*d* and 15*d* may be equal or unequal to the pitches P1 to P3.

Figure 4:
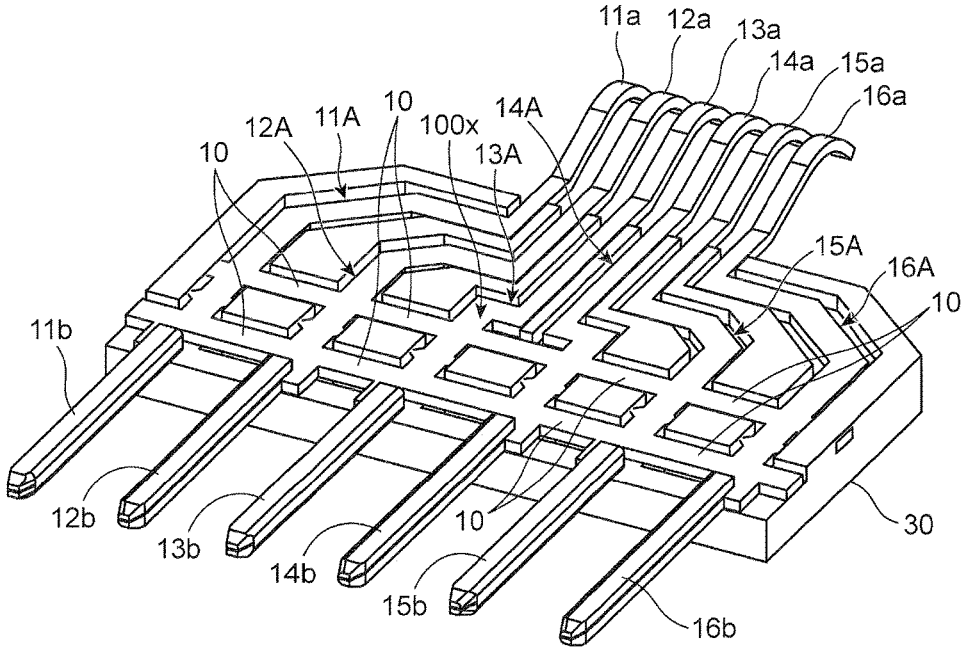
FIG. 4 is a perspective view of the metal sheet inserted into a holder.
Figure 5:
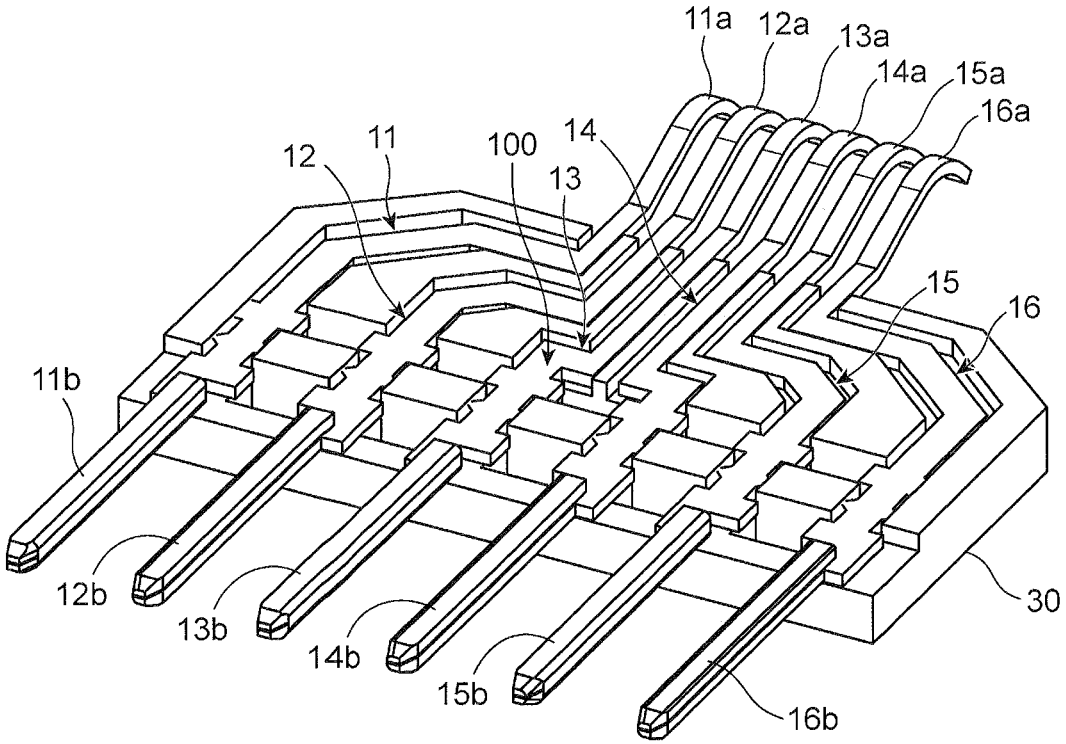
FIG. 5 is a perspective view of the metal sheet inserted into a holder.
Figure 6:
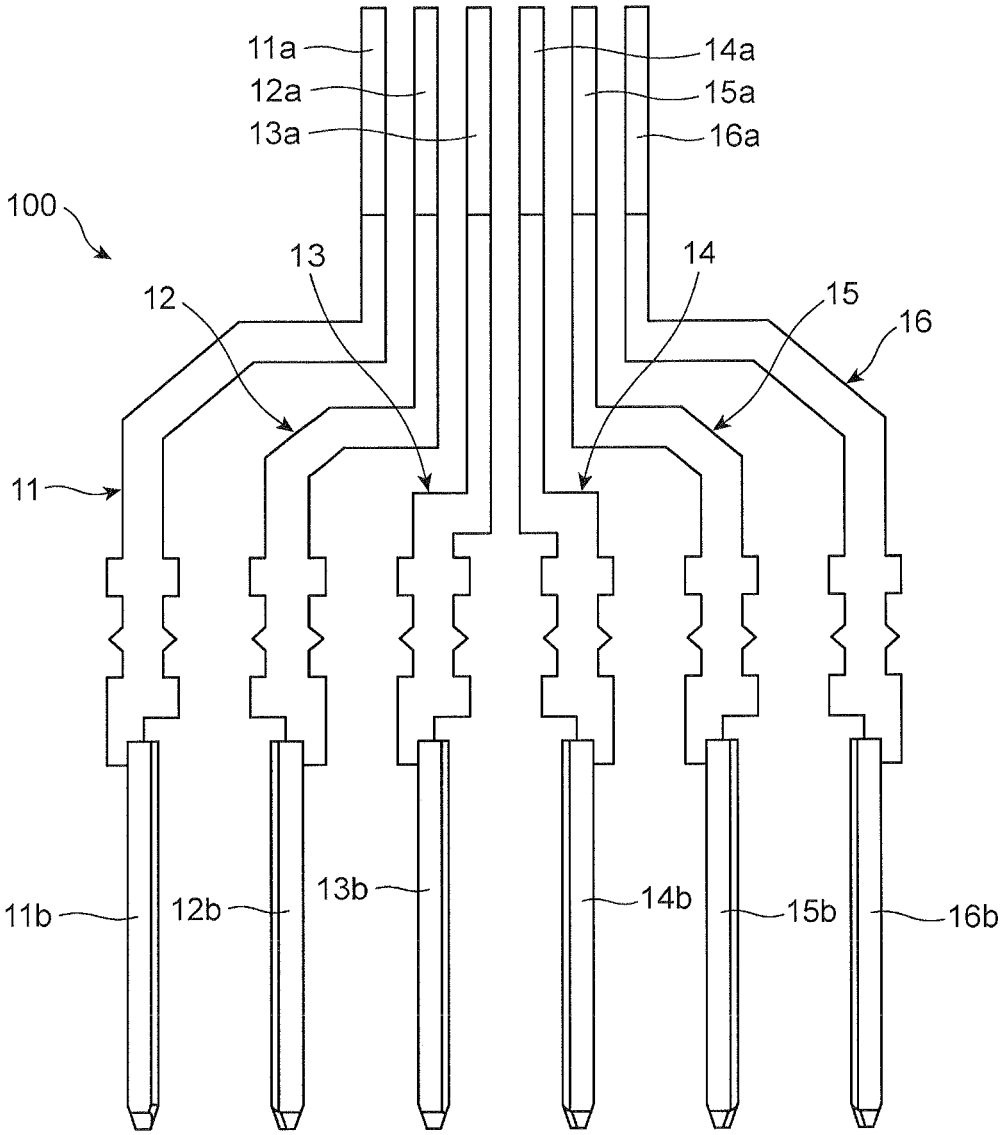
FIG. 6 is a plan view of the resultant connector terminals.
Figure 7:
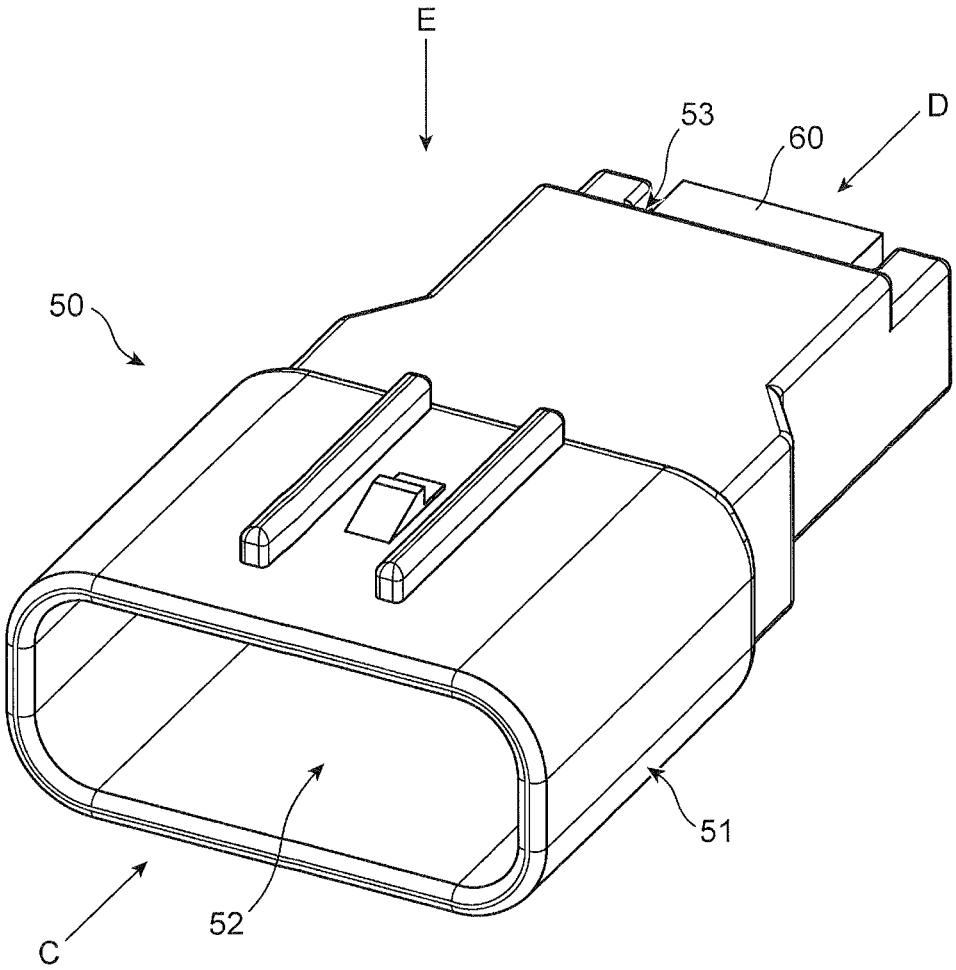
FIG. 7 is a perspective view of a relay connector in which the connector terminals fabricated by the method in accordance with the preferred embodiment of the present invention are housed.
Figure 8:
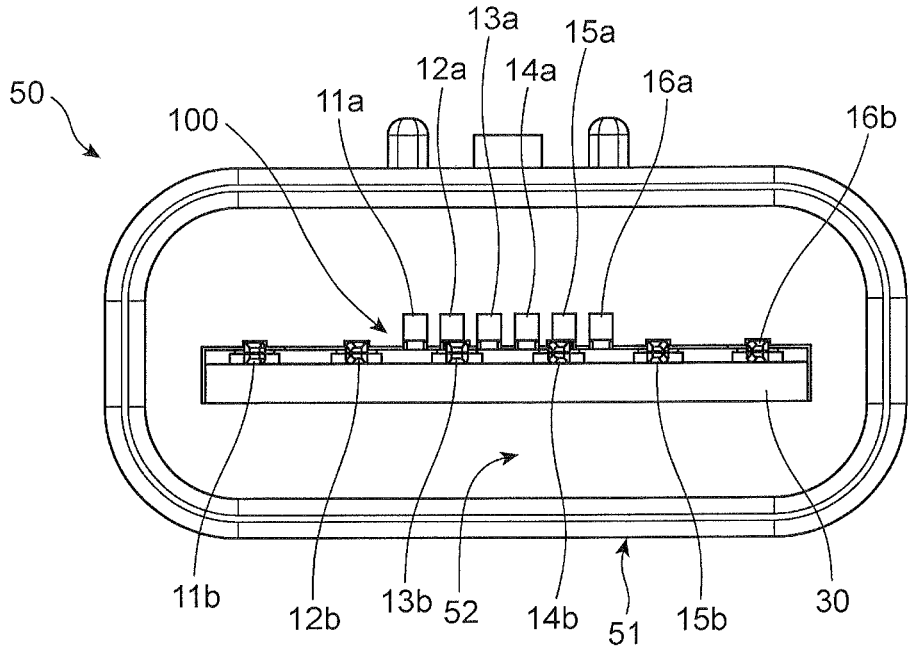
FIG. 8 is a front view of the relay connector illustrated in FIG. 7, viewed in the direction indicated with an arrow C shown in FIG. 7.
Figure 9:
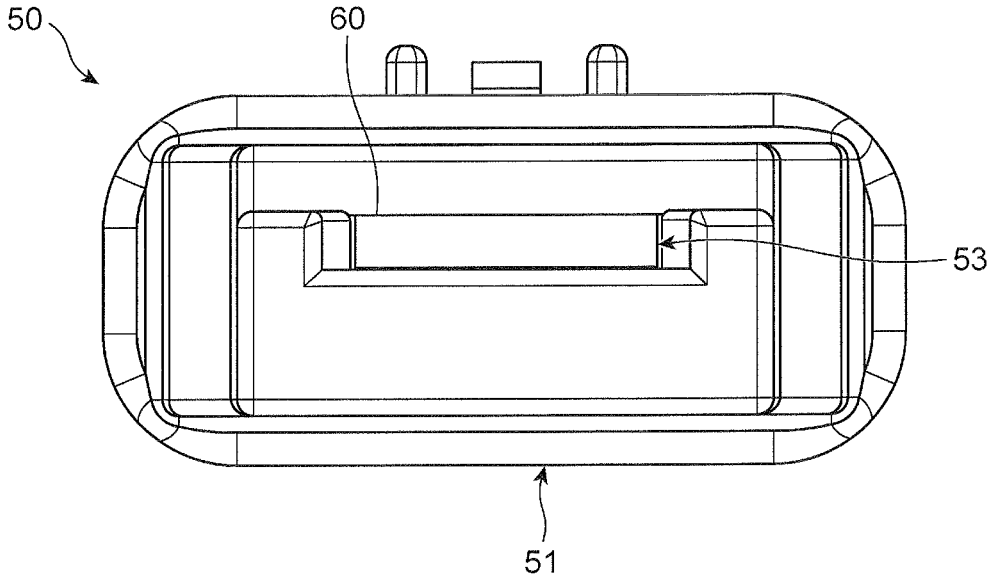
FIG. 9 is a rear view of the relay connector illustrated in FIG. 7, viewed in the direction indicated with an arrow D shown in FIG. 7.
Figure 10:
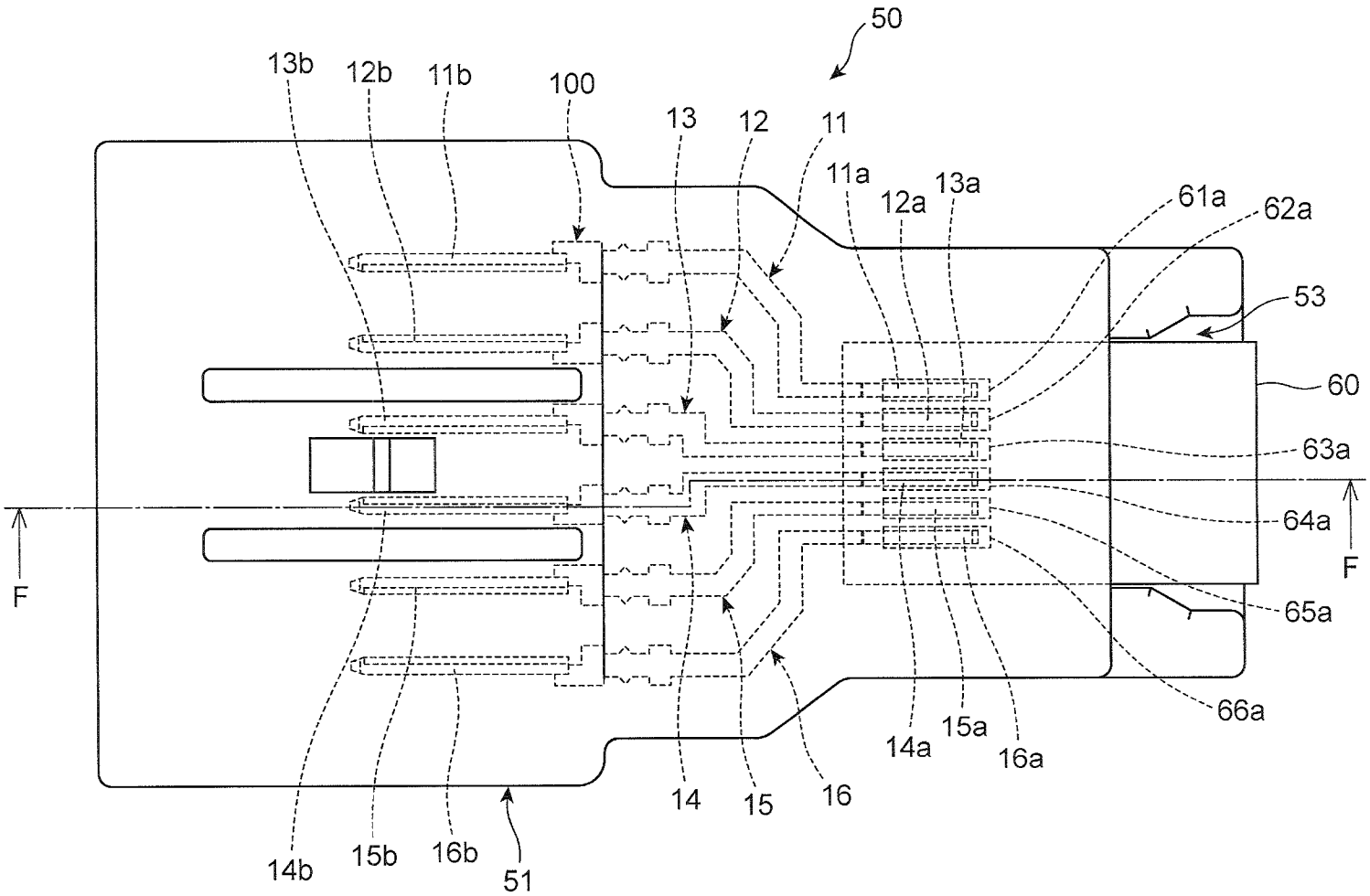
FIG. 10 is a plan view of the relay connector illustrated in FIG. 7, viewed in the direction indicated with an arrow E shown in FIG. 7.
Figure 11:
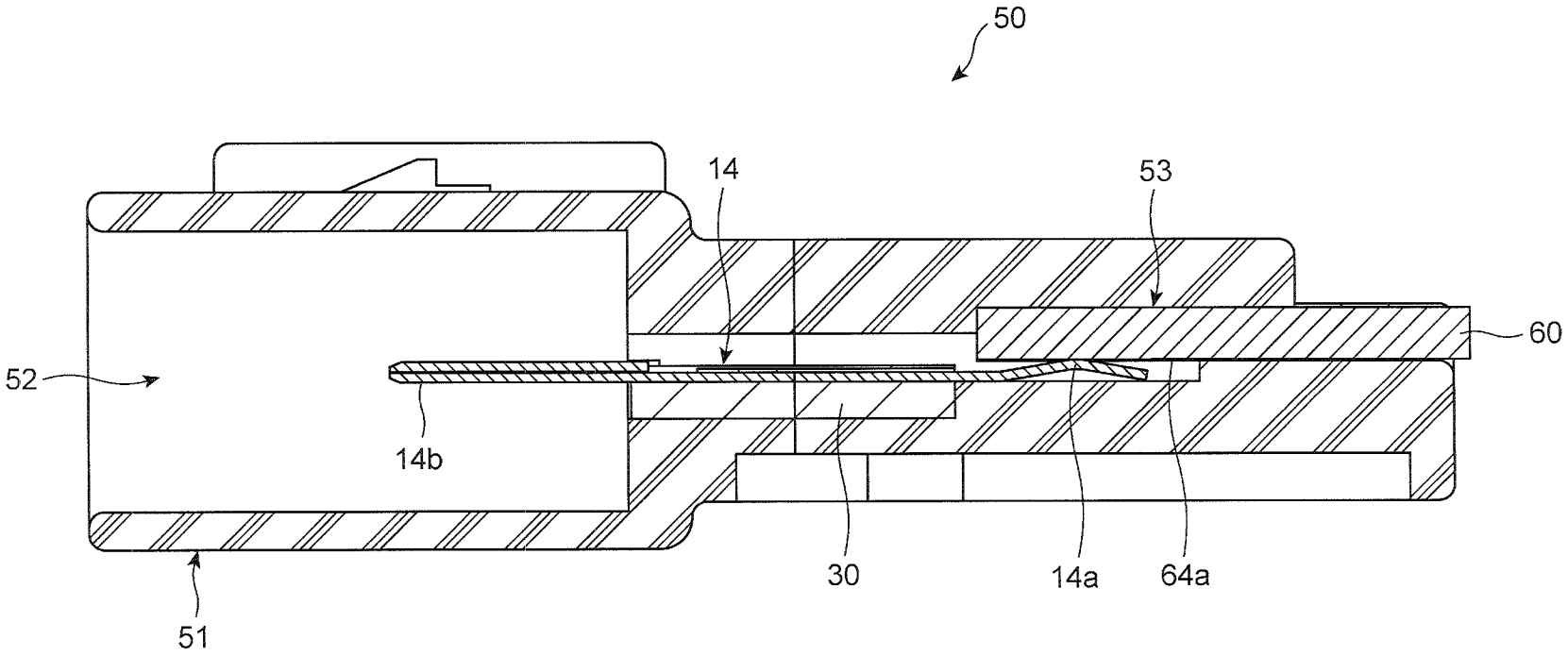
FIG. 11 is a cross-sectional view taken along the line F-F shown in FIG. 10.

As illustrated in FIG. 4, the metal sheet 100*x* including a plurality of carriers 10 is inserted into a tray or holder 30. Then, the carriers 10 are all cut off from the metal sheet 100*x*. As a result, as illustrated in FIGS. 5 and 6, the terminals 11 to 16 are formed independently of each other. The holder 30 is formed with a plurality of holes (not illustrated) through which a punch and a die are inserted for cutting the carriers 10. As illustrated in FIG. 4, the contact portions 11*a* to 16*a* and the male tabs 11*b* o 16*b* of the pre-terminals 11A to 16A extend beyond the holder 30. As an alternative, the contact portions 11*a* to 16*a* and the male tabs 11*b* o 16*b* of the pre-terminals 11A to 16A may be designed not to extend beyond the holder 30 by shortening them or enlarging the holder 30.

FIGS. 7 to 11 illustrate a relay connector 50 in which the terminals 11 to 16 are housed. The terminals 11 to 16 all inserted into the holder 30 are housed in an electrically insulative housing 51 which is a part of the relay connector 50. The male tabs 11*b* to 16*b* of the terminals 11 to 16 extend in a front opening 52 (see FIGS. 7 and 10) of the housing 51, and the contact portions 11*a* to 16*a* of the terminals 11 to 16 extend in a rear opening 53 (see FIGS. 7 and 10) of the housing 51.

As illustrated in FIGS. 7 to 11, a circuitry 60 is fit into the rear opening 53, and a female connector (not illustrated) to which a wire harness, for instance, is connected is fit into the front opening 52. The contact portions 11*a* to 16*a* make electrical contact with contact portions 61*a* to 66*a* (see FIG. 10) of the circuitry 60 fit into the rear opening 53, respectively.

The contact portions 11*a* to 16*a* of the terminals 11 to 16 may be deigned to have flexibility, and the male tabs 11*b* to 16*b* may be designed to have a predetermined thickness to thereby have enhanced rigidity, ensuring that the contact portions 11*a* to 16*a* and the male tabs 11*b* to 16*b* of the terminals 11 to 16 can accomplish requisite performances. Furthermore, since it is no longer necessary to reduce a thickness of the contact portions 11*a* to 16*a*, it is possible to avoid reduction of flexibility caused by hardening of a processed metal sheet, and further, avoid complexity in a process of fabricating the contact portions 11*a* to 16*a*.

As illustrated in FIGS. 2 and 3, the first areas 11*d* and 12*d* of the pre-terminals 11A and 12A situated adjacent to each other are folded in opposite directions. Specifically, as illustrated in FIG. 3, a right half of the first area 11*d* in the pre-terminal 11A is folded onto a left half of the first area 11*d*, as indicated with the arrow 41. Thus, the resultant terminal 11 has a two-layered or folded structure. Similarly, a left half of the first area 12*d* in the pre-terminal 12A is folded onto a right half of the first area 12*d*, as indicated with the arrow 42. Thus, the resultant terminal 12 illustrated in FIG. 6 has a two-layered or folded structure. The first areas 13*d* and 14*d* of the pre-terminals 13 and 14 and the first areas 15*d* and 16*d* of the pre-terminals 15 and 16 are formed in the same way as the first areas 11*d* and 12*d*. Furthermore, as mentioned earlier, the pitch P1 between the first areas 11*d* and 12*d*, the pitch P2 between the first areas 13*d* and 14*d*, and the pitch P3 between the first areas 15*d* and 16*d* are equal to one another. Accordingly, as illustrated in FIG. 3, a die 1M having a length equal to a sum of P1 (=P2=P3) and a width Wa of the first area 11*d* (or 12*d* to 16*d*) (see FIG. 3) can be employed commonly for folding or bending the first areas 11*d* and 12*d*, the first areas 13*d* and 14*d*, and the first areas 15*d* and 16*d*, ensuring simplification in a process of fabricating the terminals 11 to 16.

Second Embodiment

Figure 12:
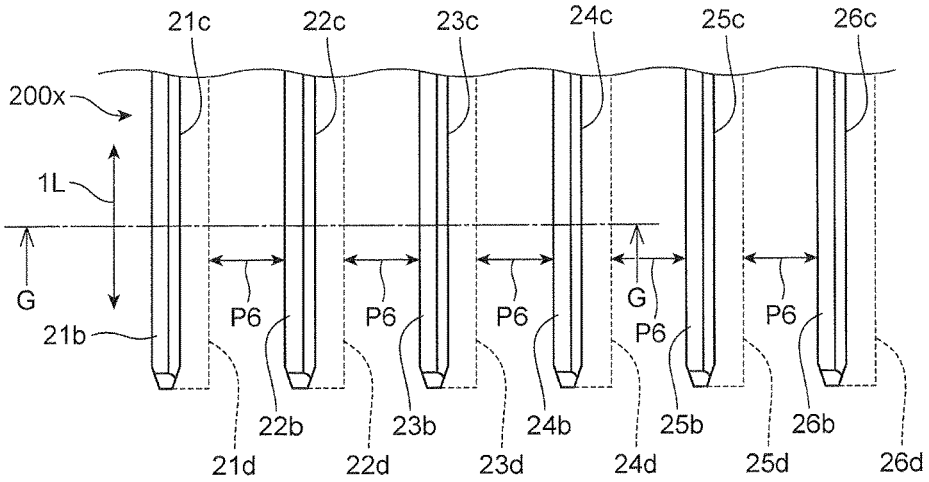
FIG. 12 is a partial plan view of a metal sheet to which the method in accordance with the preferred embodiment of the present invention is applied.

FIG. 12 is a plan view of illustrating a partial metal sheet 200*x* in accordance with the second embodiment of the present invention.

Figure 13:
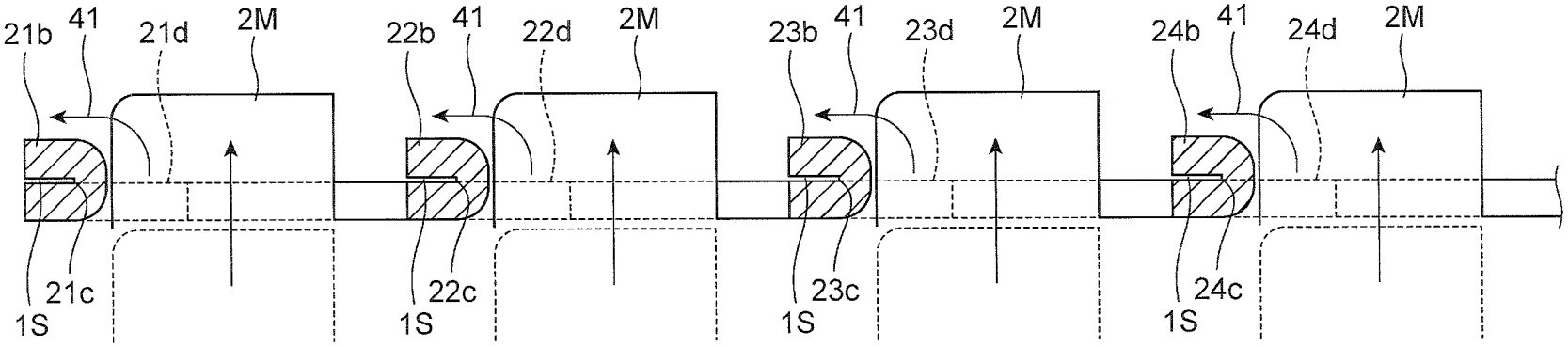
FIG. 13 is a cross-sectional view taken along the line G-G shown in FIG. 12.
Figure 14:
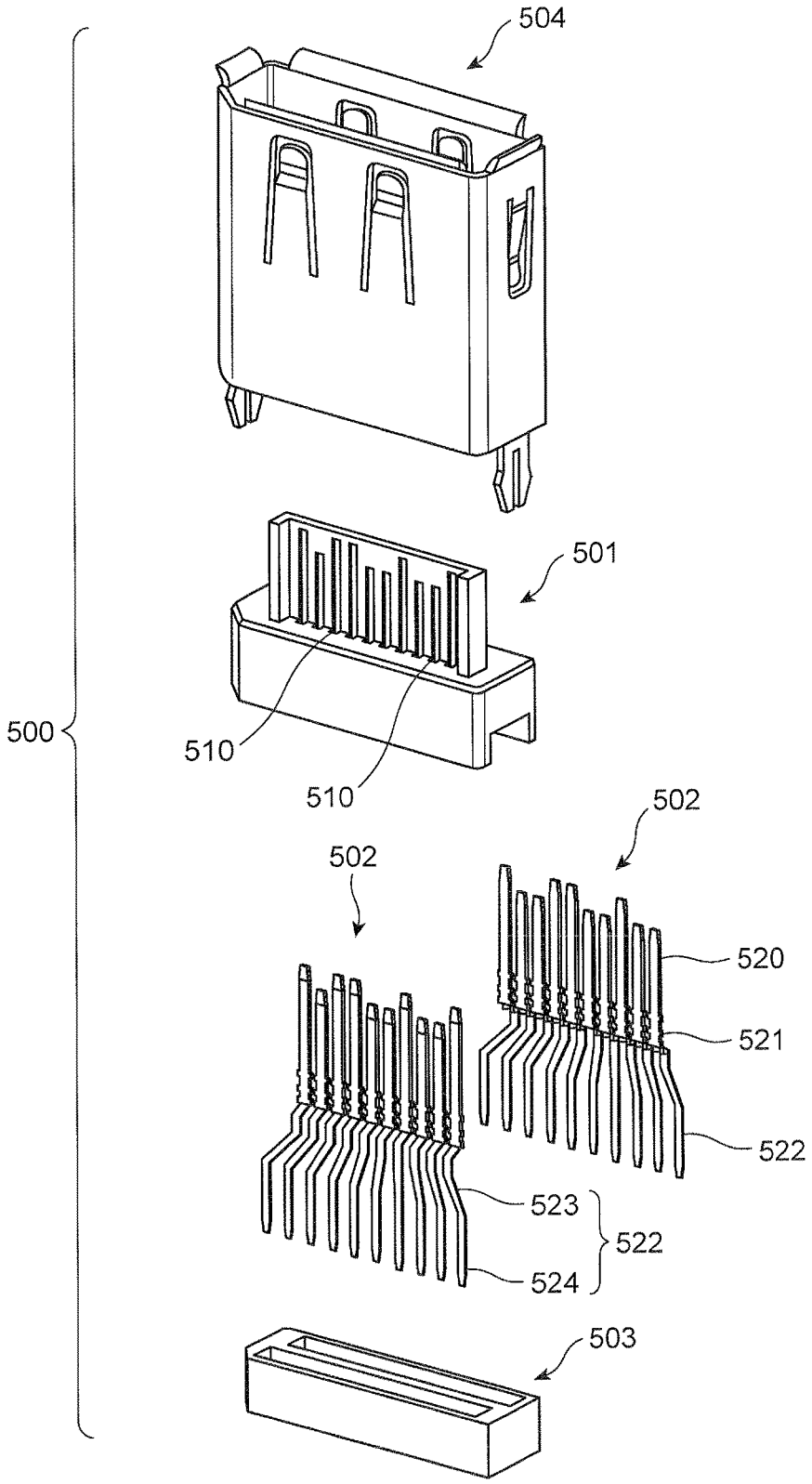
FIG. 14 is a broken perspective view of the conventional electric connector.
Figure 15:
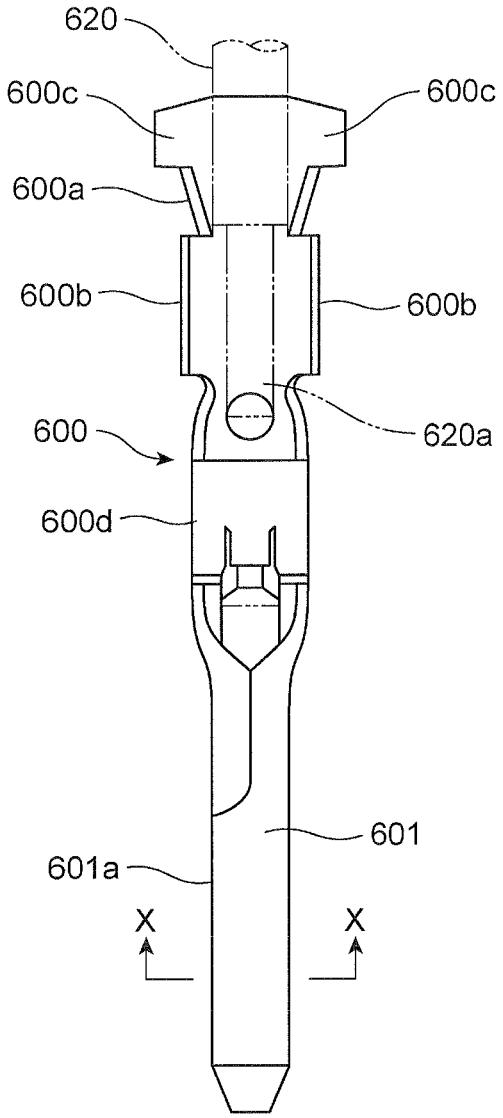
FIG. 15 is a plan view of the conventional male connector.
Figure 16:
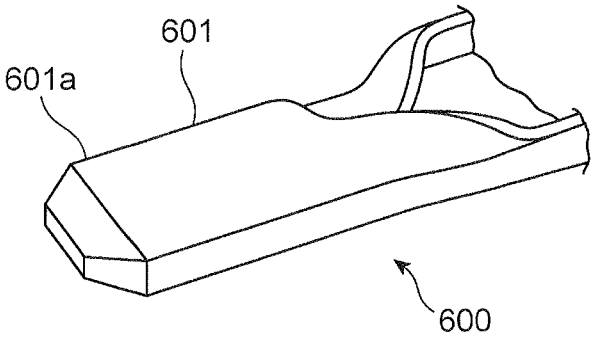
FIG. 16 is a partial perspective view of the male connector illustrated in FIG. 15.
Figure 17:
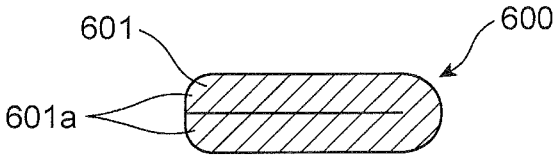
FIG. 17 is a cross-sectional view taken along the line X-X shown in FIG. 15.

The metal sheet 200*x* is designed to include first areas 21*d* to 26*d* in place of the first areas 11*d* to 16*d*. The first areas 21*d* to 26*d* are folded around lines 21*c* to 26*c* extending in a length-wise direction 1L of the first areas 21*d* to 26, to thereby define male tabs 21*b* to 26*b*. The first areas 21*d* to 26*d* are folded in the same direction unlike the first areas 11*d* to 16*d* in the first embodiment. Specifically, as illustrated in FIG. 13, a right half of the first area 21*d* in the pre-terminal

11A is folded onto a left half of the first area 21*d*, as indicated with an arrow 41. Thus, the resultant terminal 11 has a two-layered or folded structure. Similarly, a right half of each of the first areas 22*d* to 26*d* in the pre-terminals 12A to 16A is folded onto a left half of each of the first areas 22*d* to 26*d*, as indicated with the arrow 41. Thus, the resultant terminals 12 to 16 have a two-layered or folded structure.

The first areas 21*d* to 26*d* may be folded simultaneously or one by one.

A pitch P6 between the first areas 21*d* to 26*d* situated adjacent to each other is constant.

The process of fabricating the terminals 11 to 16 is not necessary to include the step of reducing a thickness of the contact portions 11*a* to 16*a*. Thus, it is ensured that the reduction of the flexibility caused by hardening of the metal sheet in a step of reducing a thickness of the metal sheet is avoidable. The metal sheet 200*x* is necessary to have a greater width when the metal sheet 200*x* is designed to be thicker, as mentioned earlier. It is not necessary to control a width of the metal sheet 200*x*, ensuring that the complexity in the process of fabricating the terminals 11 to 16 can be avoided.

As illustrated in FIG. 13, the first areas 21*d* to 26*d* are folded in the same direction indicated with the arrow 41 to form the male tabs 21*b* to 26*b*. Accordingly, a die 2M can be adjusted to each of the male tabs 21*b* to 26*b*. This ensures enhancement in an accuracy with which the first areas 21*d* to 26*d* are folded to thereby form the male tabs 21*b* to 26*b*.

The terminals 11 to 16 and the method of fabricating the same are just examples of the present invention. The scope of the present invention is not to be limited to the above-mentioned embodiments.

INDUSTRIAL APPLICABILITY

The terminals to be fabricated in accordance with the present invention can be employed broadly in various fields such as an automobile industry for electrically connecting electric parts to each other in devices to be equipped in an automobile, for instance.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-269383 filed on Dec. 26, 2013 including specification, claims, drawings and summary is incorporated herein by reference in its entirety.

What is claimed is:

1. A method of fabricating connector terminals, which method comprises:

(a) providing a single electrically conductive metal sheet including a plurality of pre-terminals, and a plurality of carriers connecting adjacent pre-terminals to each other, each of said pre-terminals having at one end thereof in a length-wise direction thereof an elastically deformable contact portion, and at the other end in said length-wise direction a first area, a pitch between adjacent contact portions being unequal to a pitch between adjacent first areas;

(b) folding each of said first areas around a line extending in a length-wise direction thereof to thereby form a male tab; and (c) removing said connectors out of said metal sheet to turn said pre-terminals into terminals, wherein said first areas situated adjacent to each other being folded in said step (b) in opposite directions, said first areas being simultaneously folded in said step (b), said step (a) being carried out by pressing said electrically conductive metal sheet.

2. The method as set forth in claim 1, wherein each of said first areas is folded in said step (b) such that there is formed a gap between facing portions of said metal sheet.

* * * * *